US008221066B2

(12) United States Patent
Burgess

(10) Patent No.: US 8,221,066 B2
(45) Date of Patent: Jul. 17, 2012

(54) AIR DIFFUSER SYSTEM FOR INDUSTRIAL PUMPS

(75) Inventor: Kevin Edward Burgess, Carlingford (AU)

(73) Assignee: Weir Minerals Australia, Ltd. (AU)

( * ) Notice: Subject to any disclaimer, the term of this patent is extended or adjusted under 35 U.S.C. 154(b) by 765 days.

(21) Appl. No.: 11/919,591

(22) PCT Filed: Apr. 10, 2006

(86) PCT No.: PCT/AU2006/000480

§ 371 (c)(1),
(2), (4) Date: Dec. 30, 2008

(87) PCT Pub. No.: WO2006/116792

PCT Pub. Date: Nov. 9, 2006

(65) Prior Publication Data

US 2009/0269201 A1 Oct. 29, 2009

Related U.S. Application Data

(60) Provisional application No. 60/676,373, filed on Apr. 29, 2005.

(51) Int. Cl.
*F04D 29/54* (2006.01)

(52) U.S. Cl. ..... 415/198.1; 415/224.5; 415/211.2; 416/183; 416/208

(58) Field of Classification Search ..... 416/183, 416/223; 415/198.1, 224.5, 211.2
See application file for complete search history.

(56) References Cited

U.S. PATENT DOCUMENTS

| | | | | |
|---|---|---|---|---|
| 3,413,925 | A | 12/1968 | Campolong | |
| 4,036,427 | A | 7/1977 | Erickson et al. | |
| 4,586,872 | A | 5/1986 | Corzilius et al. | |
| 4,750,872 | A | 6/1988 | Palliser | |
| 5,133,638 | A | 7/1992 | Mosure | |
| 5,368,440 | A * | 11/1994 | Japikse et al. | 415/208.3 |
| 5,615,997 | A | 4/1997 | Hoglund et al. | |

FOREIGN PATENT DOCUMENTS

| | | | |
|---|---|---|---|
| DE | 3412774 | A1 | 10/1985 |
| JP | 2005021806 | A | 1/2005 |
| SU | 273740 | A | 4/1968 |
| SU | 1724948 | A1 | 4/1992 |

* cited by examiner

*Primary Examiner* — Thinh T Nguyen
(74) *Attorney, Agent, or Firm* — Morriss O'Bryant Compagni

(57) ABSTRACT

An air diffuser system for an impeller for a centrifugal pump has least one channel (36) with first opening (40) through the backside (14) and a second opening (42) through the front side (38) of the impeller (12). Tubes (44) are associated with each channel (36) and extend from the backside (14) of the impeller (12). Tube ends (48) are oriented in the direction of rotation (46) of the impeller (12).

21 Claims, 3 Drawing Sheets

AIR DIFFUSER SYSTEM FOR INDUSTRIAL PUMPS

CROSS-REFERENCE TO RELATED APPLICATION

This application is a national stage non-provisional application filed under 35 U.S.C. §371 from PCT/AU2006/000480, filed Apr. 10, 2006, which claims priority under 35 U.SC. §119(e) to U.S. provisional application Ser. No. 60/676,373 filed Apr. 29, 2005.

BACKGROUND

1. Field of the Invention

This invention relates generally to industrial pumps, and more specifically though not exclusively to centrifugal pumps such as for example a slurry type end suction centrifugal pump. More particularly the invention is concerned with an air diffuser system suitable for use in such pumps.

2. Statement of the Related Art

Centrifugal pumps are used in a variety of industries to pump fluids. Slurry-type centrifugal pumps are used to process fluids which contain solid materials. Centrifugal pumps in general comprise a pump casing through which a drive shaft extends to rotate an impeller within the casing. A seal mechanism surrounds the drive shaft in the area near where the drive shaft emerges from the pump casing to attach to the impeller. The seal mechanism is provided to seal the pump casing to prevent fluid from leaking about the drive shaft and through the pump casing.

In certain applications, the fluid, or slurry, being processed by the pump may contain relatively large or small quantities of air that will naturally collect at the seal and build-up with time. For example, centrifugal pumps are widely used in flue gas desulphurization (FGD) processes to remove sulphur from the flue gases and thereby reduce the incidence of acid rain. The flue gases are scrubbed in a large tank or vessel by forcing the flue gases through a spray of fine limestone particles that are mixed with water to form a slurry. Centrifugal pumps circulate the limestone slurry from the bottom of the tank or vessel to banks of sprays positioned at the top of the tank or vessel. The flue gases enter near the bottom of the tank and exit at the top of the tank.

Air is often forced into the slurry at or near the bottom of the vessel to aid in the chemical reaction of the limestone particles within the slurry and the sulphur particles within the flue gases. Agitators are also used to circulate and mix the slurry and air. Centrifugal pumps, usually having a high flow rate capability, take the slurry feed from the bottom of the tank. Consequently, the feed slurry entering the pumps has a significant amount of air in it.

Air in slurry can cause a variety of problems in centrifugal pumps. For example, higher air content can reduce the density and pressure developed in the pump, particularly if the air is from three to five percent, or higher, by volume. Additionally, the air, being less dense than water, collects around the pump shaft (i.e., drive shaft) near or at the back of the rotating impeller near the stationary pump casing where the mechanical seal is located.

The mechanical seal typically used in centrifugal pumps generally comprises two adjacent seal members, each having a flattened face which abuts the flattened face of the other seal member. One seal member rotates with the pump shaft and impeller while the other seal member is stationary. Therefore, one seal face is moving while the other is stationary. The adjacent seal faces are held in close contact by springs and by the internal pressures of the pump when in operation. Maintaining a thin fluid film between the seal faces for lubrication and cooling is critical to seal reliability.

The seal members are made of very hard material, such as silicon carbide, so that the infiltration of particulate matter from the slurry usually does not produce any significant wear in the seal faces under normal conditions. However, when there is a higher volume of air in the slurry being processed, the air can infiltrate between the seal faces and displace the liquid film causing dry spots to form between the seal faces. As a result, the adjacent faces begin to operate or run in a dry condition in absence of lubrication, and friction increases with a concomitant increase in heat within the seal. Microcracks and chipping may form in the seal faces and may cause a rounding of the faces so that more slurry can infiltrate between the seal faces. As larger particulates infiltrate between the seal faces, more wear occurs and the seal mechanism finally begins to leak and fail.

The damage that air in slurry can cause for the seal mechanism is known in the industry. It has been proposed, for example, that apertures be formed through the back shroud of the impeller (i.e., that portion of the impeller adjacent the drive side of the pump casing) to allow the high pressure fluid to circulate back to the pump intake or low pressure suction side of the pump casing and thereby take some of the air with it. However, the apertures may become clogged with debris or solids from the slurry, or the flow through the apertures may be insufficient to remove the air, and the benefit that may be derived from the apertures is defeated.

Thus, it would be advantageous in the art of industrial pumps and the processing of slurry with higher volumes of air to provide a system for diffusing or continuously removing air from near the seal mechanism to prevent degradation of the seal as previously described, and to improve pump operation.

DESCRIPTION OF THE INVENTION

According to one aspect of the present invention there is provided an air diffuser system for an impeller for a centrifugal pump, the impeller being adapted for rotation in a normal rotation direction and including a front face and a back shroud, the air diffuser system comprising: a channel having a first opening through the back shroud and a second opening through the front face of the impeller; and a tube at said first opening of said channel, said tube having a first end which connects to said channel and a second end having tube opening configured for orientation in the normal direction of rotation of an impeller.

Preferably the tube is integral with the impeller. Furthermore the tube opening may in one form be flared.

Preferably a plurality of channels and associated tubes are provided, the channels being spaced apart and arranged generally circularly around the impeller with respect to its axis of rotation.

The or each tube may be of any suitable shape such as generally L-shaped or C-shaped. The or each tube may include one arm thereof having its free end connected to the channel and extending away from the shroud and another arm thereof extending generally in the normal direction of rotation of the impeller. Preferably the junction between the two arms is curved to facilitate good flow characteristics.

According to another aspect of the present invention there is provided an impeller for a centrifugal pump, the impeller being adapted for rotation in a normal rotation direction and includes an impeller body including a front face and a back shroud and an air diffuser system as described above.

In one form the impeller body includes a hub and a recess surrounding said hub, the or each said tube being disposed within said recess. In one form the recess has a settable material within the recess to assist in retaining the or each said tube in position.

According to yet another aspect of the present invention there is provided a method of fitting an air diffuser system to an impeller, the impeller including a front side and a back side and at least one channel having a first opening through the back side and a second opening through the front side the method including the steps of fitting a tube to the first opening of the channel, the tube being configured with a first end which connects to said channel and a second end having a tube opening which is arranged so as to face generally in the direction of normal rotation of the impeller.

Preferred embodiments of the invention will hereinafter be described with reference to the accompanying drawings and in those drawings.

Figure 1:
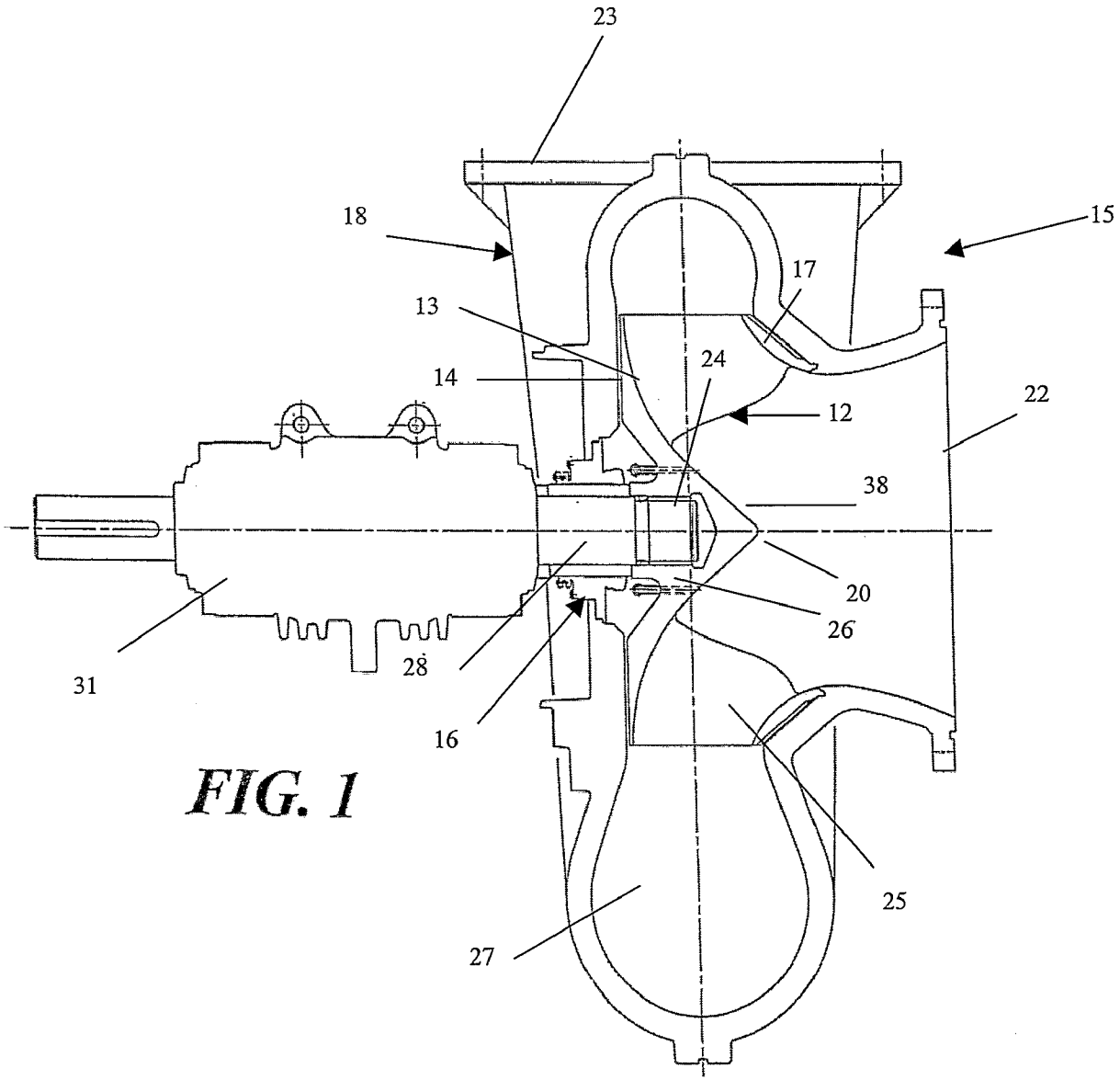
FIG. 1 is a schematic cut away side view of a pump assembly including an impeller with an air diffuser according to one embodiment of the present invention.
Figure 2:
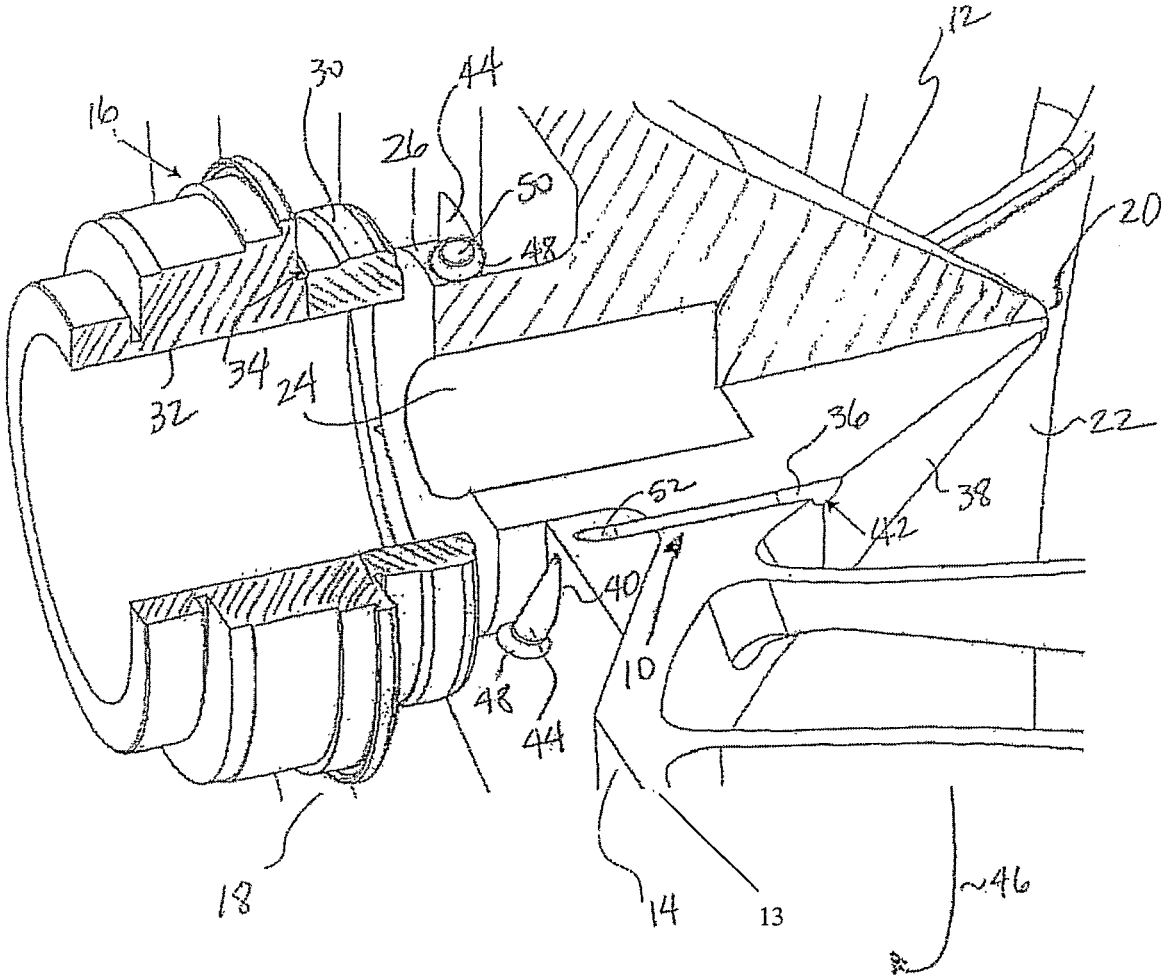
FIG. 2 is a detail of part of the impeller shown in FIG. 1.

Referring to FIG. 1, there is shown a pump assembly 15 which includes a pump casing 18 having a chamber 27 therein, an inlet 22 and an outlet 23. An impeller 12 is disposed within the chamber 27 and includes a back side 14 a front side 38 and a plurality of blades 25 terminating at an eye 20. The impeller 12 further includes a back shroud 13, a front shroud 17 and a hub 26 having an opening 24 therein for receiving a drive shaft 28 which is operatively connected to a drive motor (not shown) via a pump bearing assembly 31 and gear box (not shown). A seal mechanism 16 provides a seal for the drive shaft 28. As best shown in FIG. 2, the seal mechanism 16 includes a rotating seal member 30 a stationary seal member 32 with a seal face 34 therebetween.

The air diffuser system 10 of the invention is illustrated in detail in FIG. 2, which depicts a view of a portion of the impeller 12, as seen from the back side 14, and the seal mechanism 16. The impeller 12 and seal mechanism 16 are shown in partial cross section. The impeller 12 is positioned within the pump casing 18 with the eye 20 of the impeller 12 oriented toward to inlet 22 of the pump.

The seal mechanism 16 is positioned against or in close proximity to the hub 26 of the impeller 12 and surrounds the drive shaft to seal the drive shaft and pump casing 18 from fluid slurry being processed by the pump. The seal mechanism 16 generally comprises a rotating seal member 30 and a stationary seal member 32, each having a seal face adjacently positioned and in contact with each other at seal face 34.

The air diffuser system 10 of the invention comprises a plurality of channels 36 formed through the impeller 12 and extending from the back side through the back shroud 14 to the front side 38 of the impeller 12. Each channel 36 has a first opening 40 through the back side 14 and a second opening 42 through the front side 38 of the impeller 12. The air diffuser system 10 further comprises tubes 44 which extend outwardly from the back side 14 of the impeller and are oriented in the direction of rotation 46 of the impeller 12. The channels 36 are disposed in close proximity to the hub 26.

The tubes 44 are connected to or formed integral with respective first openings 40 of each of the channels 36 formed through the impeller 12. The tubes 44 provide fluid communication with the second opening 42 of each channel 36. The tubes 44 are formed with a flared end 48 surrounding an opening 50 to the tube 44. In operation, as the impeller 12 spins, fluid moves behind the impeller 12 into the region near the hub 26 of the impeller 12 and near the seal mechanism 16, as previously described. The flared ends 48 of the tubes 44, being oriented in the direction of rotation of the impeller 12, capture fluid which has infiltrated into the region near the hub 26 and forces the fluid through the opening 50 of the tube 44, into the channel 36 and out to the low pressure suction side of the impeller 12 at the inlet 22. Removal of fluid by this means also removes, or diffuses, air from the region of the hub 26 to lessen the deleterious effects of air on the seal mechanism 16 as previously described. In an alternative embodiment, the tubes may be of larger diameter and be devoid of a flared end as previously described.

Figure 4:
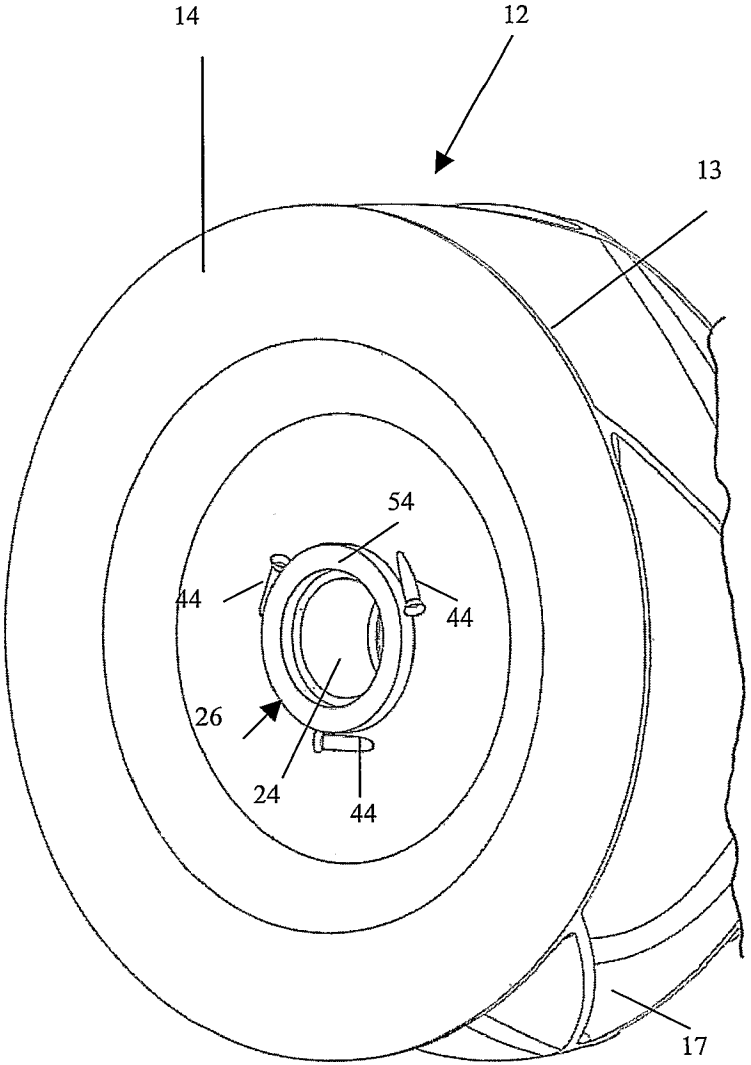
FIG. 4 is a view of a modified form of impeller.
Figure 3:
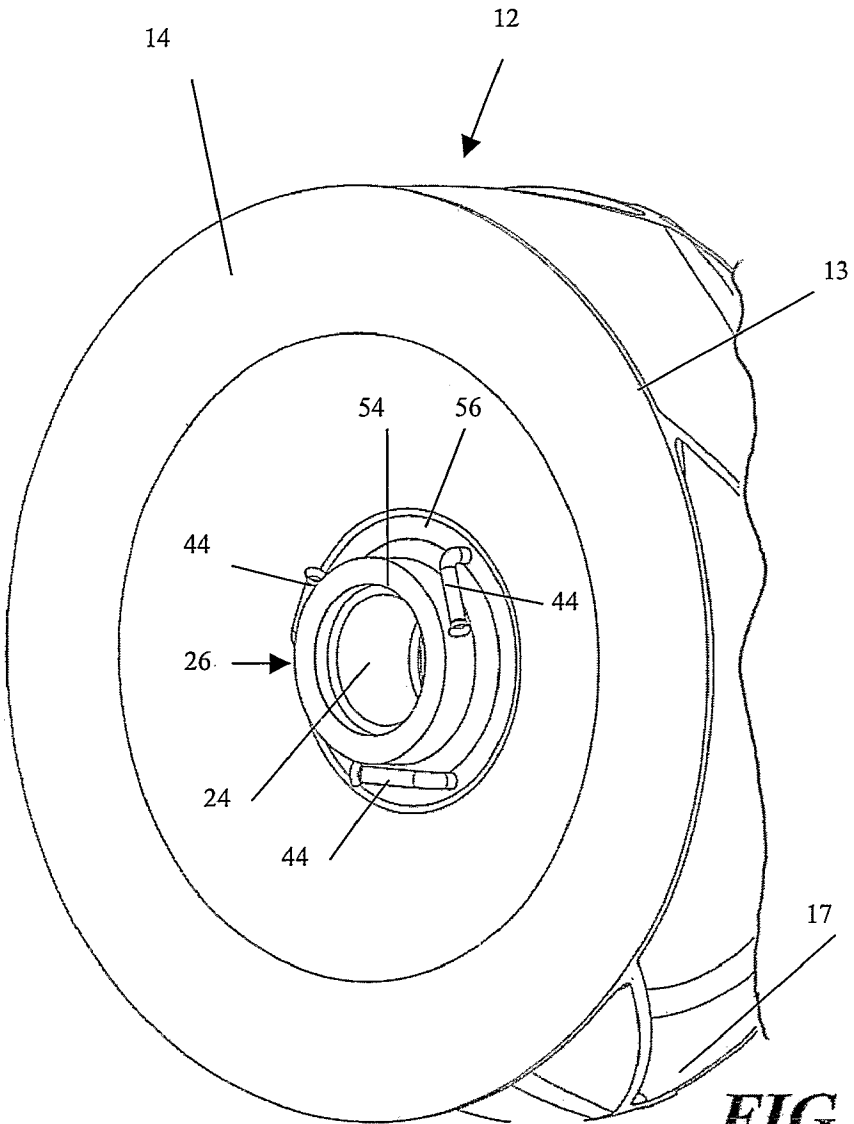
FIG. 3 is a further view of the impeller.

FIGS. 3 and 4 illustrate the position and orientation of the tubes 44 relative to the hub 26.

The air diffuser system 10 of the invention is structured by first forming channels 26 through the impeller 12 as shown. The channels 26 may be formed during casting of the impeller 12 or may be formed by machining. The tubes 44, which are preferably made of a very strong and corrosion resistant material such as stainless steel, are then inserted into the channels 36 by placement of the first end 52 of the tube 44 into the first opening 40 of the channel 36. The tubes 44 are positioned so that the flared end 50 of the tube 44 is located just below the end face 54 of the hub 26 as shown in FIGS. 3 and 4. The flared ends 48 of the tubes 44 are also positioned in close proximity to the circumferential wall of the hub 26. The tubes 44 may be held in place, for example, by pouring a fluid such as polyurethane into the recess 56 (as best seen in FIG. 3) surrounding the hub 26 to a depth just below the flared ends 48 of the tubes 44. Another method of holding the tubes in place and protecting the tubes from wear is by using a castable wear compound. Other means of securing the tubes 44 in place within their respective channels and with the proper placement and orientation are possible.

The air diffuser system of the present invention may be incorporated into newly cast impellers or may be retrofitted to existing impellers in existing pumps. It will be appreciated that this invention has general application to all pumps where the presence of air in the pumped fluid can result in a mechanical seal "running dry".

Finally, it is to be understood that various alterations, modifications and/or additions may be incorporated into the various constructions and arrangements of parts without departing from the spirit or ambit of the invention.

The invention claimed is:

1. An air diffuser system for an impeller for a centrifugal pump, the impeller being adapted for rotation in a normal rotation direction and including a front side and a back side, the air diffuser system comprising:

at least one channel having a first opening through the back side and a second opening through the front side of the impeller; and a tube associated with each said at least one channel, said tube being at said first opening of said channel, said tube having a first end which connects to said channel and a second end having a tube opening configured for orientation generally in the direction of rotation of an impeller.

2. The air diffuser system of claim 1 wherein said tube is integral with the impeller.

3. An air diffuser system according to claim 1 wherein the tube opening is flared.

4. An air diffuser system according to claim 1 wherein a plurality of said channels and associated tubes are provided, said channels being spaced apart and arranged generally circularly around the impeller with respect to its axis of rotation.

5. An air diffuser system according to claim 1 wherein each tube includes one arm having its free end connected to the channel and extending away from the shroud and another arm extending generally in the direction of rotation of the impeller, the junction between the two arms being curved to facilitate relatively smooth fluid flow.

6. An air diffuser system according to claim 5 wherein each said tube is generally L-shaped.

7. An air diffuser system according to claim 5 wherein each tube is generally C-shaped.

8. An impeller for a centrifugal pump, the impeller being adapted for rotation in a normal rotation direction and including an impeller body including a front side and a back side and an air diffuser system which includes:

a channel having a first opening through the back side and a second opening through the front side of the impeller; and a tube positioned in said first opening of said channel, said tube having a first end which connects to said channel and a second end having a tube opening configured for orientation in the direction of rotation of an impeller.

9. An impeller according to claim 8 wherein said tube is integral with the impeller.

10. An impeller according to claim 8 wherein the tube opening is flared.

11. An impeller according to claim 8 wherein a plurality of said channels and associated tubes are provided, said channels being spaced apart and arranged generally circularly around the impeller with respect to its axis of rotation.

12. An impeller according to claim 8 wherein each tube includes one arm having its free end connected to the channel and extending away from the shroud and another arm extending generally in the direction of rotation of the impeller, the junction between the two arms being curved to facilitate relatively smooth fluid flow.

13. An impeller according to claim 12 wherein each said tube is generally L-shaped.

14. An impeller according to claim 13 wherein each tube is generally C-shaped.

15. An impeller according to claim 8 wherein said impeller body includes a hub and a recess surrounding said hub, each said tube being disposed within said recess.

16. An impeller according to claim 15 wherein said recess has a settable material within the recess to assist in retaining each said tube in position.

17. A method of fitting an air diffuser system to an impeller, the impeller including a front side and a back side and at least one channel having a first opening through the back side and a second opening through the front side the method including the steps of fitting a tube to the first opening of the channel, the tube being configured with a first end which connects to said channel and a second end having a tube opening which is arranged so as to face generally in the direction of rotation of the impeller.

18. An air diffuser system for an impeller for a centrifugal pump, the impeller being adapted for rotation in a normal rotation direction and including a front side and a back side, the air diffuser system comprising:

at least one channel having a first opening through the back side and a second opening through the front side of the impeller; and a conduit associated with each said at least one channel, each said conduit being at said first opening of said channel, and said conduit having a first end which connects to said channel and a second end having a conduit opening configured for orientation generally in the direction of rotation of an impeller.

19. An air diffuser system according claim 18 wherein a plurality of said channels and associated conduits are provided, said channels being spaced apart and arranged generally circularly around the impeller with respect to its axis of rotation.

20. An air diffuser system for an impeller for a centrifugal pump, the impeller being adapted for rotation in a normal rotation direction and including a front side and a back side, the air diffuser system comprising:

at least one channel having a first opening through the back side and a second opening through the front side of the impeller; and a flow director associated with each said at least one channel, each said flow director being at said first opening of said channel, said flow director having a first end which connects to said channel and a second end having an opening configured for orientation generally in the direction of rotation of an impeller.

21. An air diffuser system according to claim 20 wherein a plurality of said channels and associated flow directors are provided, said channels being spaced apart and arranged generally circularly around the impeller with respect to its axis of rotation.

* * * * *